US006773358B1

(12) United States Patent
Sumitomo et al.

(10) Patent No.: US 6,773,358 B1
(45) Date of Patent: Aug. 10, 2004

(54) GOLF CLUB SHAFT

(75) Inventors: Norio Sumitomo, Hyogo (JP); Masahide Onuki, Hyogo (JP)

(73) Assignee: Sumitomo Rubber Industries., LTD, Kobe (JP)

( * ) Notice: Subject to any disclaimer, the term of this patent is extended or adjusted under 35 U.S.C. 154(b) by 0 days.

(21) Appl. No.: 09/295,273

(22) Filed: Apr. 20, 1999

(30) Foreign Application Priority Data

Apr. 20, 1998 (JP) ..... 10-109942

(51) Int. Cl.[7] ..... A63B 53/10
(52) U.S. Cl. ..... 473/319
(58) Field of Search ..... 473/316–323; 428/36.3, 36.9; 264/635; 156/187, 188

(56) References Cited

U.S. PATENT DOCUMENTS 5,380,389 A * 1/1995 Lo ..... 273/80 R
5,421,573 A * 6/1995 Kawamatsu ..... 273/80 B
5,735,753 A * 4/1998 Hoffmeyer ..... 473/318
6,106,413 A * 8/2000 Kusumoto ..... 473/319

FOREIGN PATENT DOCUMENTS

| | | | |
|---|---|---|---|
| JP | 3-82486 | * | 4/1991 |
| JP | 3227616 | | 10/1991 |
| JP | 10328338 | | 12/1998 |
| JP | 1176480 | | 3/1999 |

* cited by examiner

*Primary Examiner*—Stephen Blau
(74) *Attorney, Agent, or Firm*—Birch, Stewart, Kolasch & Birch, LLP

(57) ABSTRACT

At least one layer of inclined prepregs having reinforcing fiber oriented an angles not 0° and 90° with respect to the axis of a golf club shaft is wound by unintegral turns more than zero at at least one part of the golf club shaft in an axial direction thereof. A part of the prepreg(s) corresponding to partial turns obtained by subtracting integral turns form the unintegral turns forms an anisotropic region. In this manner, it is possible to obtain an anisotropic shaft in which the angle of the reinforce fiber is partly different from that of other parts in the circumferential direction of the shaft and further, at at east one part in the thickness direction thereof.

7 Claims, 9 Drawing Sheets

GOLF CLUB SHAFT

FIELD OF THE INVENTION

This invention relates to an anisotropic golf club shaft and more particularly to a method of improving the strength of the anisotropic golf club shaft and enhancing productivity thereof.

DESCRIPTION OF THE RELATED ART

Needless to say, it is advantageous to hit a golf ball straight to get a good score and fly it a long distance. However, many golfers puzzle over the fact that golf balls hit are likely to be curved, i.e., they fly a so-called hook ball or a slice ball.

The golf ball is curved because the orientation of the orbit of a club head and the orientation (orientation of line normal to face of club head) of the face of the club head are not coincident with each other at an impact time. That is, when the face (orientation of line normal to face of the club head) of the club head is directed to the right with respect to the orbit of the club head, the golf ball is curved to the right (slice in the case of right-handed player), whereas when the face of the club head is directed to the left with respect to the orbit of the club head, the golf ball is curved to the left (slice in the case of right-handed player).

Thus, to fly the golf ball straight to an aimed direction, it is necessary to correct the orientation of the face of the club head at an impact time. But it is not easy to correct a swinging form. Thus, many players puzzle over how to correct their swinging forms.

In Japanese Laid-Open Patent Publication No. 3-227616, the present applicant describes that in a hollow or solid shaft having an anisotropic material such as fiber reinforced resin or the like formed at at least one part of the shaft, a fibrous angle of the anisotropic material is differentiated (varied) partly in a circumferential direction of the shaft and at at least one part of the shaft in the thickness direction thereof to differentiate the principal elastic axis of the shaft from the principal geometric axis. In this manner, the principal elastic axis can set at an arbitrary position.

In the hollow shaft in which the principal elastic axis is differentiated from the principal geometric axis to set it at an arbitrary position, when a load is so applied downward to the shaft that the load does not pass through a point located on the principal elastic axis, the hollow shaft is flexed and twisted, as shown in FIGS. 15 and 16. That is, as shown in FIG. 15, supposing that one end of a hollow shaft 10 is denoted by a fixed end 10*c* and that the other end thereof is denoted by a free end 10*d*, a principal elastic axis E is not coincident with a principal geometric axis G, and the free end 10d is positioned upward from a point Q located on the principal elastic axis E. When a load W not passing through the point Q located on the principal elastic axis E is applied to the free end 10*d* of the shaft 10, the shaft 10 is flexed and twisted, as shown in FIG. 16.

Further, the present applicant proposed a golf club to which a hollow shaft having the above-described anisotropic property is applied, as disclosed in Japanese Laid-Open. Patent Publication No. 10-328338. According to the disclosure made therein, the shaft is twisted by the flexure thereof when the golf club is swung so that when a hooker or a slicer uses the golf club, the orientation (orientation of line normal to face of club head) of the face of the club head is self-corrected. In the golf club, the club head is installed on the end of the anisotropic shaft which is flexed and twisted such that a line normal to the face of the club head is oriented to the direction in which a golf ball is to be flied, i.e., the face of the club head is oriented to a specific direction owing to twisting of the shaft at a desired angle caused by flexure thereof which occurs when the golf club is swung.

In the above Japanese Laid-Open Patent Publication No. 10-328338, an anisotropic shaft is manufactured by winding on a mandrel (a molding core rod) a semi-circumference prepreg in a region of $0° \leqq \theta < 180°$ (first semi-circumference region) and in a region of $180° \leqq \theta 360°$ (second semi-circumference region) in the circumferential direction of the shaft, respectively such that reinforcing fibers of both prepregs incline in opposite directions with respect to the axial direction of the shaft. A plurality of layers each consisting of two semi-circumference prepregs inclining in opposite directions is wound on the mandrel to produce the anisotropic shaft. According to this method, an uncontinuous portion of the reinforcing fibers is formed in the boundary between the first semi-circumference region and the second semi-circumference region. Thus, the strength of the shaft is low at the uncontinuous portion. Further, two semi-circumference prepregs are used to form one layer. Thus, it takes long to manufacture the golf club shaft and further, there may be a variation in the characteristics of products. To solve the problems, the present applicant proposed a golf club shaft and a method of manufacturing the golf club shaft, as disclosed in Japanese Laid-Open Patent Publication No. 11-76480.

In the golf club shaft and the method of manufacturing the golf club shaft, a hoop layer whose reinforcing fibers are substantially perpendicular to the axial direction of the shaft is layered on the boundary (uncontinuous portion of reinforcing fiber) between the first semi-circumference region consisting of one semi-circumference prepreg whose reinforcing fibers incline in one direction and the second semi-circumference region consisting of the other semi-circumference prepreg whose reinforcing fibers incline in the opposite direction. This is to prevent deterioration of the strength of the boundary therebetween. The two semi-circumference prepregs whose reinforcing fibers incline in opposite directions are bonded to the hoop layer to prepare a composite prepreg sheet in advance. The composite prepreg sheet is wound on the peripheral surface of the mandrel to manufacture the golf club shaft, thereby a period of time of manufacturing can be short and a degree of variation in the characteristics of products can be reduced.

However, in the proposal disclosed in Japanese Laid-Open Patent Publication No. 11-76480, it is possible to allow the strength and productivity of the shaft to be higher than those of the shaft not provided with the hoop layer. But the shaft has a seam (boundary between two semi-circumference prepregs) present in each layer, namely, in one turn of each layer consisting of the first and second semi-circumference prepregs. Thus, the strength of the shaft is still low.

It is ideal that the edges of the two prepregs are butted each other at the seam without forming a gap therebetween and overlapping them on each other. But it is difficult to butt them each other in such an ideal state in factories because they are operated for a mass production. Thus, there is necessarily a variation in the finish of the seam. In other words, in order to accomplish such an ideal butting of the prepregs, it is necessary for skilled operators to work without sparing any effort and time, which lowers the productivity of the shaft greatly. The above-described gap between the two prepregs and the overlapping thereof are defects of the shaft in its construction. Thus, in much consideration of the durability of the shaft, namely, such a defect cannot be ignored.

In the case of the conventional shaft (principal elastic axis and principal geometric axis are coincident with each other), in order to allow the shaft to have a uniform property in its circumferential direction, a prepreg is wound by at least one turn, without changing the material thereof. In the case of the anisotropic shaft, the semi-circumference prepreg is used. Thus, when the same amount of prepreg is used to manufacture the anisotropic shaft and the conventional shaft, the total number of prepregs to be used in the former is more than that of prepregs to be used in the latter. Further, in the case of the anisotropic shaft, it is necessary to butt two prepregs each other for each circumference (turn), and the width of the semi-circumfeence prepreg is small, which makes it troublesome to handle it. Thus, the productivity of the anisotropic shaft is low.

SUMMARY OF THE INVENTION

The present invention has been made in view of the above-described situation. It is an object of the present invention to improve strength and productivity of an anisotropic golf club shaft which can be flexed and twisted by differentiating its principal elastic axis and principal geometric axis from each other, then can be used preferably by the hooker or slicer.

In order to achieve the object, there is provided a golf club shaft having a plurality of fiber reinforced resinous layers which are layered one upon another in a winding state, wherein one or more layers of said layers are inclined fiber reinforced resinous layers in which reinforcing fibers are oriented at angles not 0 and 90° with respect to an axis of said golf club shaft and, at least one layer of said inclined fiber reinforced resinous layers is wound by an unintegral turns more than one turn so as to apply an anisotropic property to the shaft.

When a fiber reinforced resinous layer (prepreg) whose reinforcing fibers incline with respect to the axis of the shaft is wound, let it be supposed that the number of turns thereof is "X+Y" (X is an integer more than 1 (one turn), Y is a value more than 0 and less than 1). In this case, a part of the entire fiber reinforced resinous layer (prepreg) wound by X turns, namely, by an integral number of times in a semi-circumference region ($0° \leqq 180°$) and a part of the entire fiber reinforced resinous layer wound by the integral number of times in a circumference region ($180° \leqq \theta 360°$) are symmetrical with respect to the axis of the shaft, and the reinforcing fibers incline in the same direction with respect to the axis of the shaft. But the fiber reinforced resinous layer (prepreg) wound at Y turns forms a part in which the orientation of the reinforcing fiber thereof is different from that of the reinforcing fibers of the other parts not only in the circumferential direction of the shaft but also in the thickness direction thereof.

Accordingly, in the golf club shaft of the present invention having the above-described construction, the angle of the reinforcing fiber is partly different from that of the reinforcing fiber of the other parts in the circumferential direction of the shaft and further, at at least one part in the thickness direction thereof. Thus, the shaft is flexed and twisted.

In the golf club shaft of the present invention, as the part of the fiber reinforced resinous layer wound by X turns and the part of the fiber reinforced resinous layer wound by Y turns are composed by one prepreg sheet. Thus, the shaft of the present invention is formed without an uncontinuous portion between the part wound by X and the part wound by Y. Therefore, the shaft has a higher degree of strength than the conventional anisotropic shaft which is composed of the semi-circumference prepregs. Further, because the prepreg of the present invention has one circumference or more, i.e., it is wound by one turn or more, the number of the prepregs of the shaft of the present invention is smaller than that of the prepregs of the conventional anisotropic shaft formed of the semi-circumference prepregs. Furthermore, in the present invention, it is unnecessary to perform prepreg-butting operation. Thus, the shaft of the present invention can be manufactured in a higher productivity than the conventional shaft.

Preferably, the unintegral turns of the fiber reinforced resinous layers wound by more than 1 (one turn) is N+0.5 (N is an integer of one or more ). The way of winding the prepreg efficiently allows a part in which the prepreg is wound by 0.5 turns to be anisotropic.

According to the present invention, there is provided a golf club shaft having a first inclined fiber reinforced resinous layer in which reinforcing fibers are oriented at an angle of $\alpha°(0°<\alpha<90°)$ with respect to an axis of the golf club shaft and a second inclined fiber reinforced resinous layer in which reinforcing fibers are oriented at an angle of $-\alpha°$ with respect thereto and which is adjacently layered in a winding state at one portion or more of the golf club shaft, wherein a winding start position of the first inclined fiber reinforced resinous layer and a winding start position of the second inclined fiber reinforced resinous layer are spaced at 180° in a circumferential direction of the golf club shaft and the first inclined fiber reinforced resinous layer and the second inclined fiber reinforced resinous layer are wound by N+0.5 turns (N is an integer of one or more) respectively.

In the above construction in which the reinforcing fibers are adjacently layered one on the other and incline in opposite directions, the semi-circumference region of one of the first and second inclined fiber reinforced resinous layers at the winding termination side thereof and the semi-circumference region of the other of the first and second inclined fiber reinforced resinous layers at the winding termination side thereof are positioned in a first circumference region ($0° \leqq \theta < 180°$) of the shaft and a second circumference region ($180° \leqq \theta < 360°$) thereof, respectively. Similarly, the semi-circumference region of one of the first and second inclined fiber reinforced resinous layer at the winding start side thereof and the semi-circumference region of the other of the first and second inclined fiber reinforced resinous layers at the winding termination side thereof are positioned in the first circumference region ($0° \leqq 0\ \theta < 180°$) of the shaft and the second circumference region ($180° \leqq \theta < 360°$) thereof, respectively. Consequently, it can be the that the construction is substantially same as the construction in which the semi-circumference prepregs whose reinforcing fibers incline in the opposite directions are wound on the first circumference region ($0° \leqq \theta < 180°$) of the conventional anisotropic shaft and the second circumference region ($180° \leqq \theta < 360°$) thereof, respectively. Thus, the shaft having the construction is flexed and twisted.

In the golf club shaft of the present invention, because the semi-circumference prepreg is not used, there is no seam formed between the semi-circumference prepregs. Thus, the shaft of the present invention has a higher degree of strength than the conventional anisotropic shaft which is composed of the semi-circumference prepregs. Further, because the prepreg of the present invention has one circumference or more, i.e., it is wound by one turn or more, the number of the prepregs of the shaft of the present invention is smaller than that of the prepregs of the conventional anisotropic shaft formed of the semi-circumference prepregs. Furthermore, in the present invention, it is unnecessary to perform prepreg-butting operation. Thus, the shaft of the present invention can be manufactured in a higher productivity than the conventional shaft.

In manufacturing the golf club shaft of the present invention, prepregs composing the first inclined fiber reinforced resinous layer and the second inclined fiber reinforced resinous layer are bonded to each other, by dislocating at 180°, from each other, ends of the respective two prepregs at a winding start side thereof before prepregs are wound on the mandrel, such that when the two prepregs are wound on the mandrel, winding start positions of the two prepregs are dislocated at 180° in a circumferential direction of the mandrel. Then, the two prepregs bonded to each other are wound on the mandrel. According to the method, it is possible to decrease a number of winding prepregs separately on the mandrel and thus improve the productivity of the shaft.

In the present invention, as reinforcing fibers of the fiber reinforced resin, it is possible to use a glass fiber, a carbon fiber, various organic fibers, an alumina fiber, a silicon carbide fiber, metal fiber and/or fibers consisting of a mixture of these fibers, a woven cloth or a mat. As resin, it is possible to use polyamide, epoxy, polyester, and the like.

It is possible to form the golf club shaft of only the fiber reinforced resinous layer. Further, it is possible to use an unanisotropic layer such as a fiber reinforced rubber layer and a rubber layer having an orientation in combination with the fiber reinforced resinous layer. In addition, it is possible to use a resin layer or rubber layer not containing fiber at a part of the golf club shaft.

The anisotropic part which allows the shaft to flex and twist may be provided partly thereon in its axial direction. That is, the anisotropic part may be provided on the shaft entirely or partly in its axial direction.

DETAILED DESCRIPTION OF THE EMBODIMENT

Figure 1:
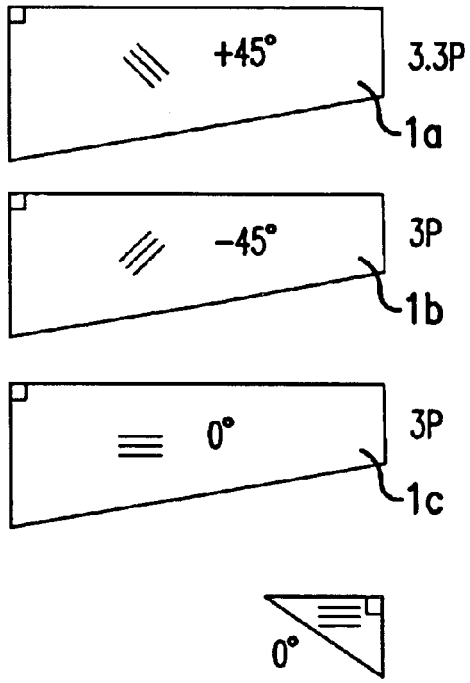
FIG. 1 is a development view of a prepreg constituting a shaft of a first embodiment.

The embodiment of the present invention will be described below with reference to the drawings. In the drawings, prepregs are shown at short length compared with an actual length.

Figure 2:
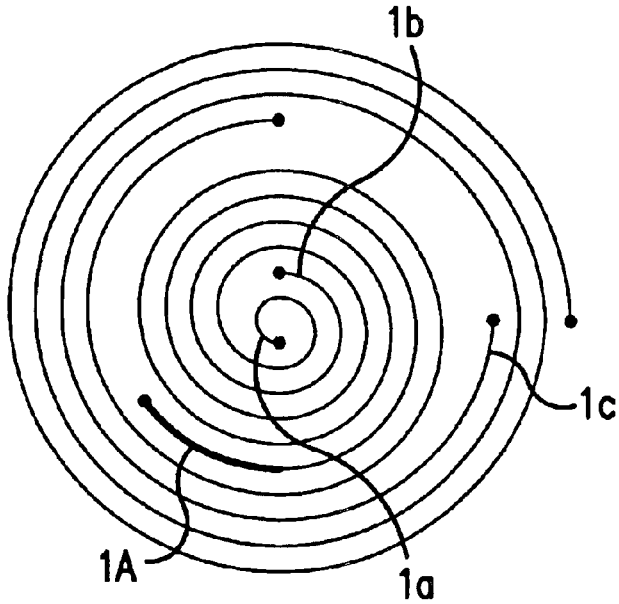
FIG. 2 shows a winding state of the prepreg constituting the shaft of the first embodiment.
Figure 3:
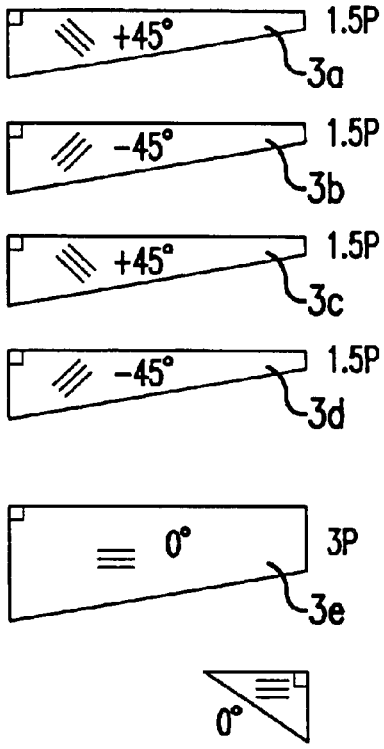
FIG. 3 is a development view of a prepreg constituting a shaft of a second embodiment.
Figure 4:
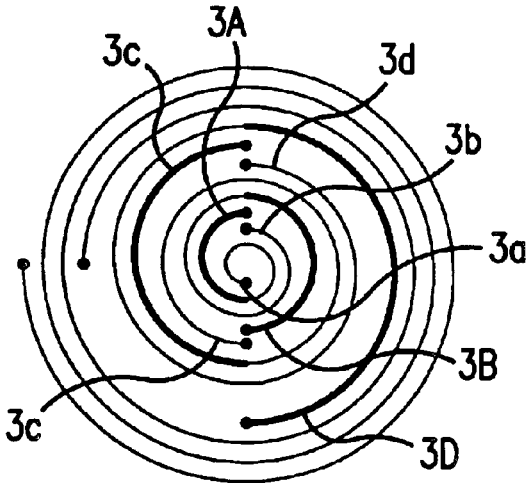
FIG. 4 shows a winding state of the prepreg constituting the shaft of the second embodiment.
Figure 5:
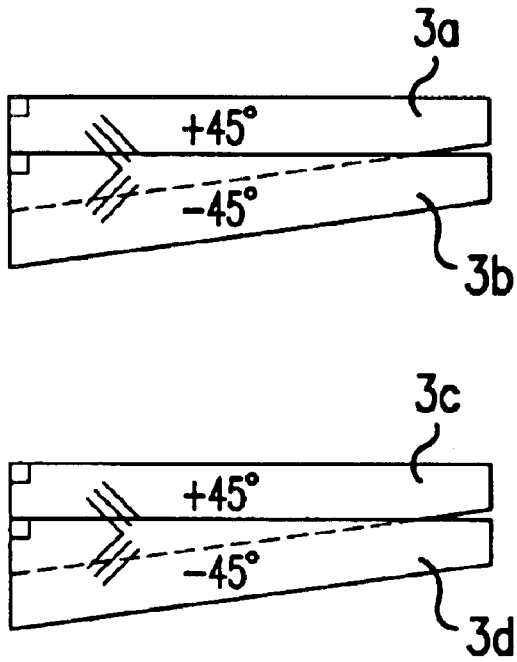
FIG. 5 shows a bonding state of prepregs shown in FIG. 3.

FIGS. 1 and 2 show developed and wound states of a prepreg (fiber reinforced resinous layer) constituting a shaft of the first embodiment. FIGS. 3 through 5 show developed and wound states of a prepreg constituting a shaft of the second embodiment.

Figure 6:
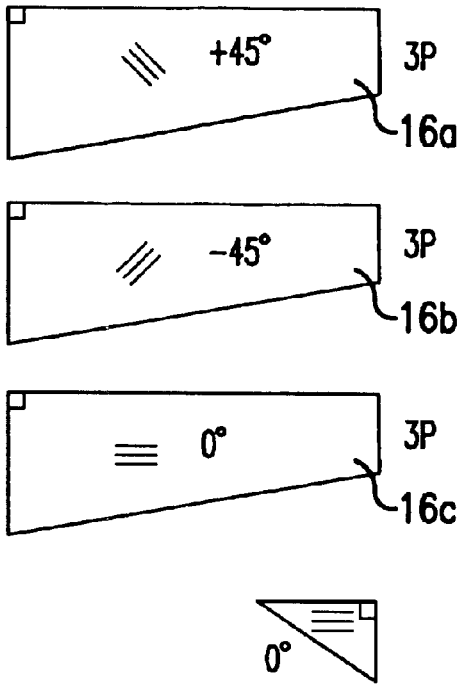
FIG. 6 is a development view of a prepreg constituting a shaft of a first comparison example.
Figure 7:
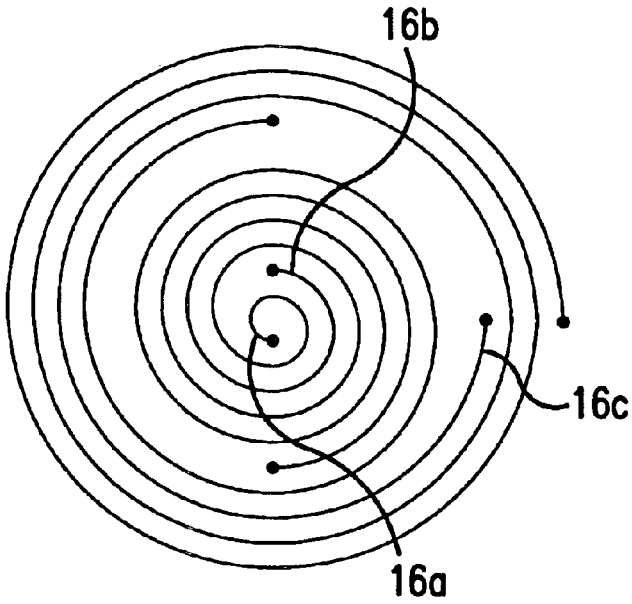
FIG. 7 shows a winding state of the prepreg constituting the shaft of the first comparison example.
Figure 8:
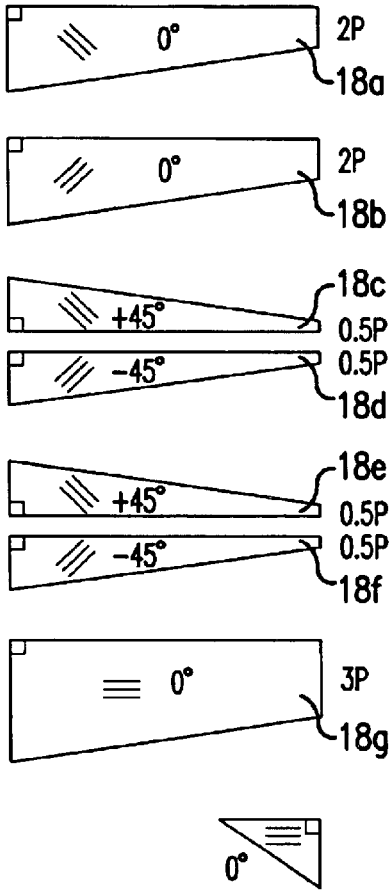
FIG. 8 is a development view of a prepreg constituting a shaft of a second comparison example.
Figure 9:
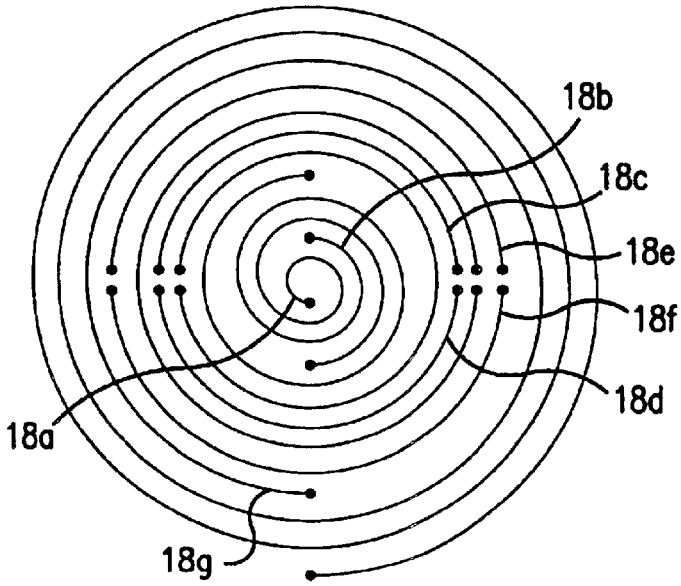
FIG. 9 shows a winding state of the prepreg constituting the shaft of the second comparison example.
Figure 10:
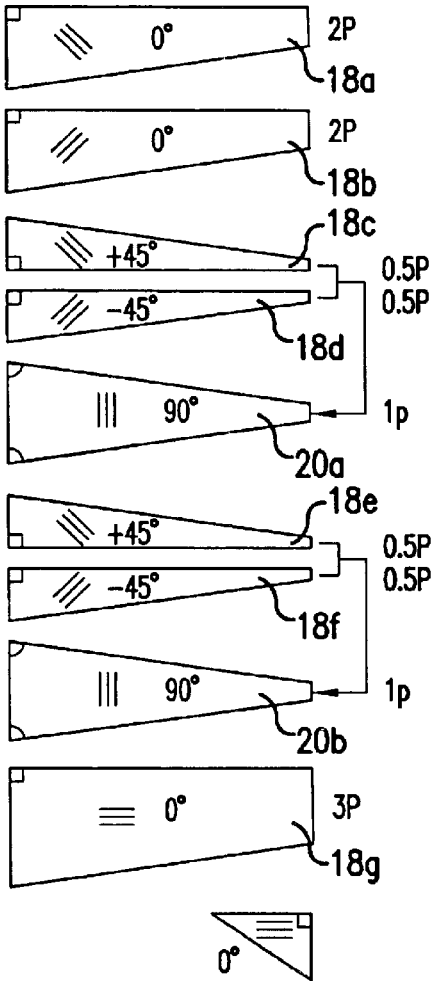
FIG. 10 is a development view of a prepreg constituting a shaft of a third comparison example.
Figure 11:
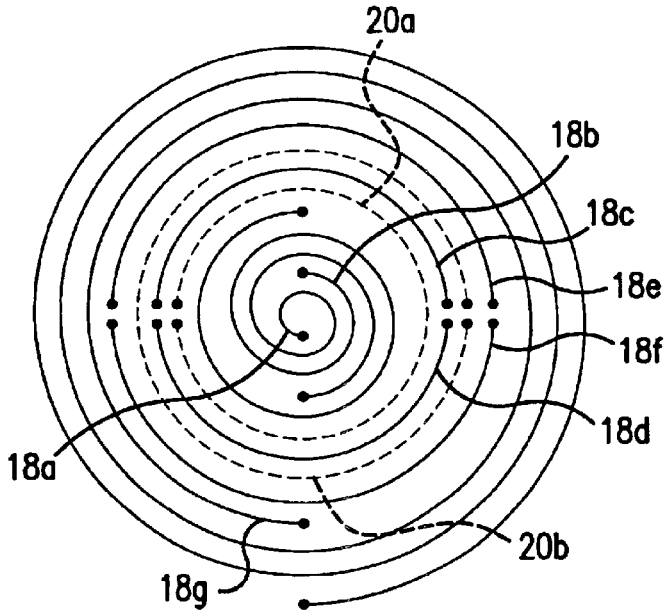
FIG. 11 shows a winding state of the prepreg constituting the shaft of the third comparison example.

FIGS. 6 and 7 show developed and wound states of a prepreg (fiber reinforced resinous layer) constituting a shaft of a first comparison example. FIGS. 8 and 9 show developed and wound states of a prepreg constituting a shaft of a second comparison example. FIGS. 10 and 11 show developed and wound states of a prepreg constituting a shaft of a third comparison example.

Numerical values attached to each prepreg in FIGS. 1. 3, 5, 6, 8, and 10 indicate the orientation angle of the reinforcing fiber of the prepreg with respect to the axis of each shaft. 0.5P, 1P, 1.5P, 2P, 3P, and 3.3P attached to the right side of each prepreg indicate the number of turns (number of circumferences) of each prepreg. That is, 0.5P, 1P, 1.5P, 2P, 3P, and 3.3P indicate 0.5 turns, 1 turn, 1.5 turns, 2 turns, 3 turns and 3.3 turns. A triangular prepreg sheet shown at the lowermost position indicates a reinforcing prepreg sheet to be wound on a small diameter-end of each shaft on which a club head is installed.

Prepreg sheets which are used in the embodiments and the comparison examples and whose reinforcing fibers had orientation angles of 0°, −45°, +45° are all carbon fiber reinforced resin prepreg 8055S-12 manufactured by Toray Corp (thickness: 01.1053 mm, content of carbon fiber: 76 wt%, CF tensile modulus of elasticity: 30,000 kg, and CF tensile strength: 560 kg). A prepreg sheet (corresponding to hoop layer disclosed in Japanese Laid-Open Patent Publication No. 11-76480) which is used in only the third comparison example and whose reinforcing fiber had an orientation angle of 90° is prepreg 805-3 manufactured by Toray Corp (thickness: 0.0342 mm, content of carbon fiber: 60 wt%, CF tensile modulus of elasticity: 30,000 kg, and CF tensile strength: 410 kg).

The shaft of the first comparison example (FIGS. 6 and 7) is not anisotropic, and each of prepregs 16*a*–16*c* is wound at an integral turns more than one turn. The prepreg-winding start (termination) positions of the prepregs 16*a*–16*c* are different from one another to prevent the section of the shaft from becoming uncircular. The shaft doesn't have an anisotropic layer part formed thereon. Thus, supposing that an axis perpendicular to the axis of the shaft is set at every portion in the axial direction of the shaft, the reinforcing fiber is oriented identically at both sides of the axis perpendicular to the axis of the shaft.

The shaft of the second comparison example (FIGS. 8 and 9) is an anisotropic shaft as disclosed in Japanese Laid-Open Patent Publication No. 10-328338, and prepregs 18*a* and 18*b* are wound by two turns by differentiating the winding start positions thereof from each other by 180° in the circumferential direction of the shaft. The orientation of the reinforcing fiber of the prepreg 18*c* wound in a first semi-circumference region (0°≦θ<180°) of the circumferential direction of the shaft is different from that of the reinforcing fiber of the prepreg 18*d* wound in a second semi-circumference region (180°≦θ<360°) of the circumferential direction thereof. Similarly, the orientation of the reinforcing fiber of the prepreg 18*e* wound in a first semi-circumference region (0°≦θ<180°) of the circumferential direction of the shaft is different from that of the reinforcing fiber of the prepreg 18*f* wound in a second semi-circumference region (180°≦θ<360°) of the circumferential direction thereof. A prepreg sheet 18*g* is wound by three turns as an outermost layer of the shaft.

The shaft of the third comparison example (FIGS. 10 and 11) is an anisotropic shaft as disclosed in Japanese Laid-Open Patent Publication No. 11-76480. Prepregs 20*a* and 20*b* are added to the prepreg-winding construction of the shaft of the first comparison example (FIGS. 6 and. 7). That is, the prepregs 20*a* and 20*b* correspond to the hoop layer described in Japanese Laid-Open Patent Publication No. 11-76480. The prepreg 20*a* and the prepreg 20*b* are wound by one turn, respectively. After prepregs 18*c* and 18*d* are bonded to the prepreg 20*a*, the prepregs 18*c*, 18*d*, and 20*a* combined with one another is layered on the prepreg 18*b*. After prepregs 18*e* and 18*f* are bonded to the prepreg 20*b*, the prepregs 18*e*, 18*f*, and 20*b* combined with one another was layered on the prepreg 18*d*.

In the first embodiment (FIGS. 1 and 2), a prepreg 1*a* and 1*b* are wound with 3.3 turns. The prepregs 1*a* and 1*b* are wound by differentiating winding start positions thereof from each other by 180° in the circumferential direction of the shaft. A prepreg 1*c* is wound by three turns on the prepreg 1*b* as an outermost layer of the shaft. A part 1A (thick part) of the prepreg 1*b* having a length 0.3 of one turn positioned at the winding termination side is formed as an anisotropic part. That is, owing to the presence of the part 1A having the length 0.3 of one turn of the prepreg 1*b*, the orientation state of the reinforcing fiber of the shaft is partly changed in the circumferential direction of the shaft and also changed at least one part thereof in its thickness direction.

In the second embodiment (FIGS. 3 and 4), each of prepregs 3*a*, 3*b*, 3*c*, and 3*d*is wound by 1.5 turns and wound by differentiating winding start positions thereof by 180° from one another in the circumferential direction of the shaft. A prepreg 3*e* is layered by three turns on the prepreg 3*d* as an outermost layer. A part 3A (thick line part) of the prepreg 3*a* and a part 3B (thick line part) of the prepreg 3*b* having a length 0.5 of one turn at the winding termination side are positioned at a semi-circumference region (0°≦θ<180°) and a circumference region (180°≦θ<360°), respectively. The reinforcing fiber of the prepreg 3*a* and that of the prepreg 3*b* are opposite to each other in the orientations thereof. Similarly, a part 3C (thick line part) of the prepreg 3*c* and a part 3D (thick line part) of the prepreg 3*d* having a length 0.5 of one turn at the winding termination side are positioned at a semi-circumference region (0°≦θ<180°) and a circumference region (180°≦θ<360°), respectively. The reinforcing fiber of the prepreg 3*c* and that of the prepreg 3*d* are opposite to each other in the orientations thereof. In winding the prepregs 3*a* and 3*b* on the mandrel, the part of 0.5 turns of each thereof are bonded to each other to prepare one prepreg sheet. Then, one prepreg sheet is wound on the mandrel. Similarly, in winding the prepregs 3*c* and 3*d* on the mandrel, the part of 0.5 turns of each thereof is bonded to each other to prepare one prepreg sheet. Then, one prepreg sheet is wound on the mandrel.

Static twist amounts in bending (indicating the degree of twist anisotropy), three-point bending strengths, twist failure strengths, and work time periods required to produce one shaft were measured on shafts of the comparison examples and the embodiments. Table 1 shows the result.

The static twist amounts in bending (indicating the degree of twist anisotropy), the three-point bending strengths, the twist failure strengths, and the work time periods required to produce one shaft were measured by the following methods.

Static Twist Amounts in Bending

Figure 12A:
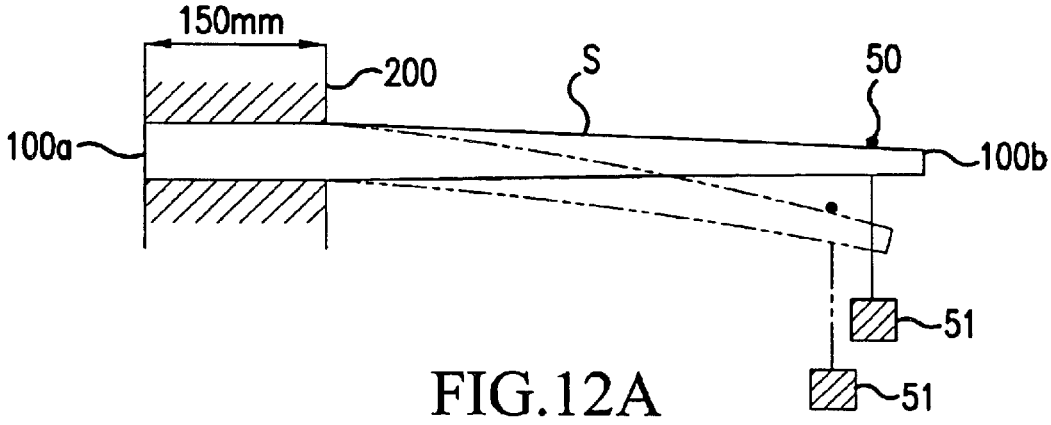
FIGS. 12A and 12B are side views showing a method of measuring a twist amount of a golf club shaft of the embodiment and the comparison examples.
Figure 12B:
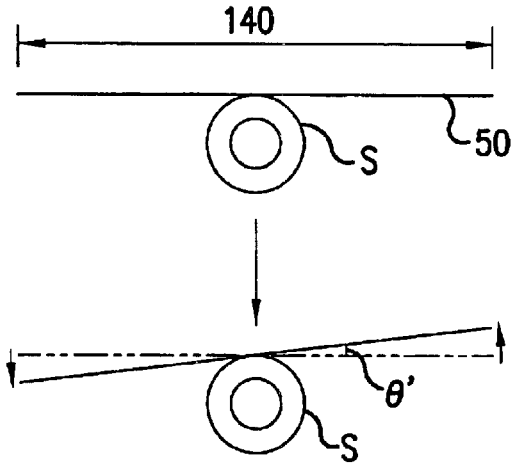

As shown in FIG. 12, a shaft S was held by a chucking device 200 which chucked a portion of the shaft S spaced at 150 mm from an end 100*a* at a grip part side of the shaft S, with the shaft S held horizontally. The center of a metal wire 60 having a length of 140 mm was bonded to the upper surface of the shaft S at a position thereof which was spaced by 98% of the entire length of the golf club from the end S-a thereof such that the metal wire 50 was horizontal and perpendicular to the axis of the shaft S. A weight 51 having a weight of 1.1 kg was hung from the shaft S at the lower end surface of the position spaced by 98% of the entire length of the golf club from the end S-a of the shaft S. The twist amount of the shaft S before and after the load of the weight 51 was applied to the shaft S was measured by a rotation angle (θ) of the metal wire 50.

(Three-point Bending Strength)

A test was conducted in accordance with "(1) three-point bending test of strength of 4.C type shaft" of "admittance standard of golf club shaft and method of checking standard (CPSA0098)" of Product Safety Association.

Figure 13:
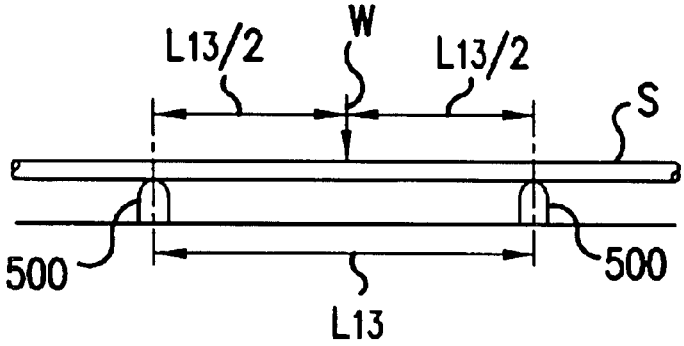
FIG. 13 shows a three-point bending strength test.

That is, as shown in FIG. 13, a shaft S was supported by a pair of supporting tools 500 in a predetermined span $L_{13}$. A load (W) was applied to a center position between the supporting tools 500 to measure a load value when the shaft S was destroyed. The measured load value was set as an evaluation value. The result is shown in table 1.

The length of the shaft S was 1143 mm. Load-applied points were T (spaced at 90 mm from the end of the shaft at its small-diameter side), A (spaced at 175 mm from the end of the shaft at its small-diameter side), B (spaced at 525 mm from the end of the shaft at its small-diameter side), and C (spaced at 175 mm from the end of the shaft at its large-diameter side). When the load-applied point was T, the span $L_{13}$ was set to 150 mm. When the load-applied points were A, B, and C, the span $L_{13}$ was set to 300 mm.

Twist Failure Strength

A test was conducted in accordance with "2 twist test" of "admittance standard of golf club shaft and method of checking standard (CPSA0098)" of Product Safety Association.

Figure 14:
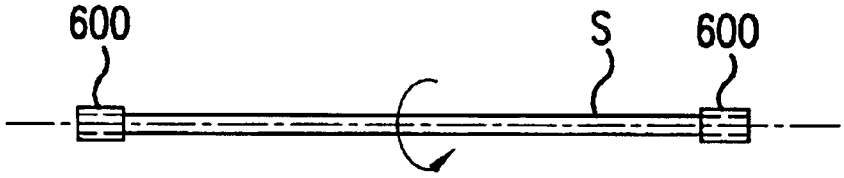
FIG. 14 shows a twist failure strength test.
Figure 15:
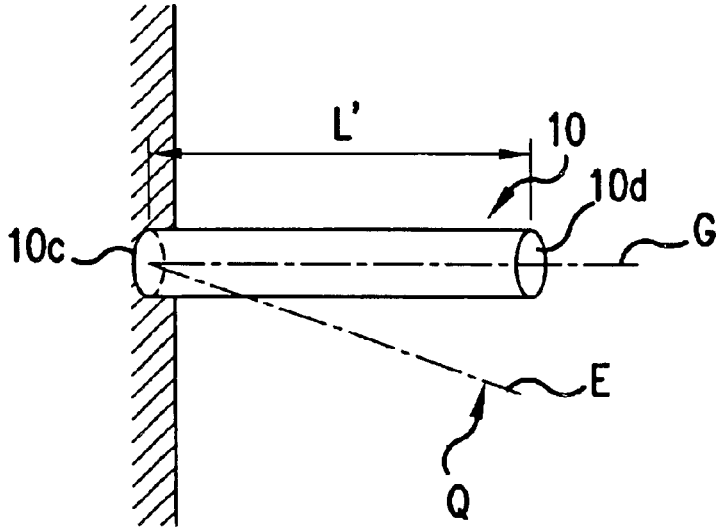
FIG. 15 is a schematic view showing the relationship between an elastic main axis and a geometric main axis of an anisotropic hollow shaft.
Figure 16A:
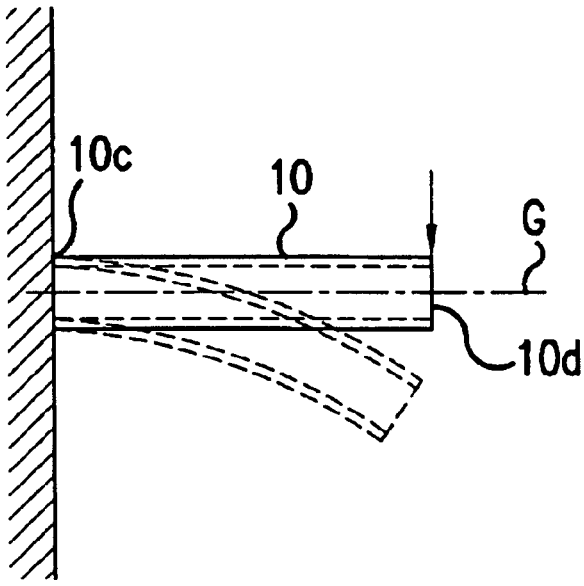
FIG. 16A is a side view showing a state in which a load is applied to an anisotropic hollow shaft.
Figure 16B:
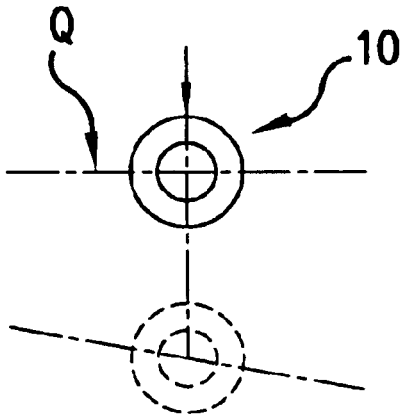
FIG. 16B is a schematic view showing a deformational behavior of an anisotropic hollow shaft.

As shown in FIG. 14, both end portions of a shaft S having a length of 50 mm were fixed by a fixing jig 600. A twist torque was applied to the shaft S until the shaft S was destroyed. A product of a torque value and a twist angle when the shaft S was destroyed was set as an evaluation value. The result is shown in table 1.

Work Time Period Required to Produce One Shaft

A period of time for producing 10 shafts of each of the comparison examples and the embodiments was measured.

That is, a period of time (for 10 shafts) required to cut prepreg materials into prepregs having a predetermined dimension and a period of time (for 10 shafts) required to wind prepregs on mandrels and form the shafts by molding were added to each other. An evaluation value was determined by dividing the total period of time by 10.

TABLE 1

| | Static Amount in Bending (°) | Three-Point Bending Failure Strength (Kg) T | A | B | C | Twist Failure Strength (Nm degree) | Winding Time Period (minute) |
|---|---|---|---|---|---|---|---|
| Comparison Example 1 | 0 | 125 | 70 | 73 | 72 | 2330 | 2.7 |
| Comparison Example 2 | 2.5 | 125 | 54 | 50 | 49 | 1098 | 4.7 |
| Comparison Example 3 | 2.5 | 124 | 62 | 58 | 58 | 1109 | 4.0 |
| Embodiment 1 | 0.8 | 129 | 72 | 75 | 73 | 2410 | 2.7 |
| Embodiment 2 | 2.5 | 125 | 72 | 75 | 74 | 2211 | 3.2 |

As shown in table 1, the shaft of the first embodiment was 0.8 in its static twist amount, then the shaft had anisotropic. As shown in FIG. 1, the shaft of the first embodiment had four prepregs layered one upon another, a number of prepregs is as same as that of the shaft (FIG. 6) of the first comparison example. The difference between both shafts is that in the shaft of the first comparison example, the prepreg (inclined fiber reinforced resinous layer) 16*a* in which the reinforcing fiber oriented by +45° with respect to the axis of the shaft is wound at a plurality of integral turns (three turns), whereas in the shaft of the first embodiment, the prepreg (inclined fiber reinforced resinous layer) 1*a* in which the reinforcing fiber oriented by +45° with respect to the axis of the shaft is wound at a plurality of unintegral turns (3.3 turns). As shown in table 1, the productivities (prepreg-winding period of time) of both shafts are equal to each other and very favorable, and the strengths thereof are also almost equal to each other and high. By comparing both shafts with each other, it is understood that in the first embodiment, it is possible to provide an anisotropic shaft having the same degree of productivity and strength as those of the conventional unisotropic shaft and not having a seam formed between prepregs.

It is understood that the shaft of the second embodiment and the shaft of each of the second and third comparison examples are in the same anisotropic state (static twist amount in bending: 2.5). That is, the parts 3A and 3B (thick line part) of each of the prepregs 3*a* and 3*b* having a length 0.5 of one turn at the winding termination side were positioned in the region ($0° \leqq \theta < 180°$) and the region ($180° \leqq \theta < 360°$), respectively in the circumferential direction of the shaft. The reinforcing fiber of the prepreg 3*a* and that of the prepreg 3*b* were opposite to each other in the orientations thereof. Similarly, the parts 3C and 3D (thick line part) of each of the prepregs 3*c* and 3*d* having a length 0.5 of one turn at the winding termination side which were positioned in the region ($0° \leqq \theta < 180°$) and the region ($180° \leqq \theta < 360°$), respectively. The reinforcing fiber of the prepreg 3*c* and that of the prepreg 3*d* were opposite to each other in the orientations thereof. The prepregs 3*a* and 3*b*, and the prepregs 3*c* and 3*d* have a function similar to that of the anisotropic layer (prepreg 18*c* and prepreg 18*d*) of the shaft of the second comparison example and that of the anisotropic layer (prepreg 18*e* and prepreg 18*f*) of the shaft of the third comparison example.

The shaft of the third comparison example has a higher degree of strength than the shaft of the second comparison example because the former has the hoop layer (prepregs 20*a* and 20*b*) provided thereon. The shaft of the second embodiment has a higher degree of strength than the shaft of the third comparison example. The shaft of the third comparison example has a higher degree of productivity than the shaft of the second comparison example. This is because in the former, the prepregs 18*c* and 18*d* are wound after they are bonded to each other on the hoop layer (prepreg 20*a*), and the prepregs 18*e* and 18*f* are wound after they are bonded to each other on the hoop layer (prepreg 20*b*). The number of the prepregs of the shaft of the second embodiment is smaller than that of the prepregs of the shaft of the third comparison example. Further, in the second embodiment, it is unnecessary to perform semi-circumference prepreg-butting operation. Thus, the shaft of the second embodiment can be manufactured in a shorter time period than the shaft of the third comparison example.

As it is apparent with above description, the present invention can obtain an anisotropic golf club shaft without using semi-circumference prepreg, then the anisotropic golf club shaft of the present invention has a higher degree of strength and productivity than the conventional anisotropic golf shaft.

Further, a face of a club head installed on the end of the anisotropic golf shaft is oriented to a specific direction owing to twisting of the shaft at a desired angle caused by flexure thereof when the golf club is swung, therefore the anisotropic golf shaft is preferable for the hooker and slicer.

What is claimed is:

1. A golf club shaft having a plurality of fiber reinforced resinous layers which are layered one upon another in a winding state, wherein one or more layers of said layers are inclined fiber reinforced resinous layers in which reinforcing fibers are oriented at angles not 0° and 90° with respect to an axis of said golf club shaft, wherein the inclined fiber reinforced resinous layers are a first inclined fiber reinforced resinous layer in which reinforcing fibers are oriented at an angle of $\alpha°$ with respect to an axis of said golf club shaft, wherein $\alpha°$ has a value of $0° < \alpha < 90°$, and a second inclined fiber reinforced resinous layer in which reinforcing fibers are oriented at an angle of $-\alpha°$ with respect thereto, wherein, the second inclined fiber reinforced resinous layer is adjacently layered on the first inclined fiber reinforced resinous layer in a winding state at one portion or more, a winding start position of the first inclined fiber reinforced resinous layer and a winding start position of the second inclined fiber reinforced resinous layer are spaced 180° in a circumferential direction of said golf club shaft, and the first inclined fiber reinforced resinous layer and the second inclined fiber reinforced resinous layer are wound by N+0.5 unintegral turns, respectively, so as to apply an anisotropic property to the shaft, wherein N is an integer of one wherein the N+0.5 turns and winding start positions of the first and the second inclined fiber reinforced resinous layer continue along an axis thereof so that same layer constructions continue along the axis of said golf club shaft of which the first and second inclined fiber reinforced resinous layers are wounded, and number of layers and thickness are the same in the golf club shaft circumferential direction.

2. The golf club shaft according to claim 1, wherein the first fiber reinforced resinous layer and the second fiber reinforced resinous layer are bonded to form one prepreg sheet.

3. The golf club shaft according to claim 1, wherein a part of the inclined fiber resinous layer corresponding to decimal turns obtained by substructing integral turns from the unintegral turns forms an anisotropic region and an angle of the reinforcing fiber of the anisotropic region is different from that of other region in a circumferential direction of the shaft.

4. The golf club shaft according to claim 3, wherein the anisotropic property is applied to the shaft by the anisotropic region, so that the shaft is twisted by a flexure thereof when the shaft is swung.

5. The golf club shaft according to claim 4, wherein a face of a club head installed on the shaft is oriented to a direction, in which a golf ball hit by a hooker or a slicer is to be flied, owing to twisting of the shaft.

6. The golf club shaft according to claim 1, wherein one or more of said fiber reinforced resinous layers have reinforcing fiber whose orientation angle is 90° and/or 0° with respect to the shaft.

7. The golf club shaft according to claim 1, wherein the fiber reinforced resinous layers are composed of prepreg sheets.

* * * * *